US006488276B2

(12) United States Patent
Sheng et al.

(10) Patent No.: US 6,488,276 B2
(45) Date of Patent: Dec. 3, 2002

(54) PAPER FEEDING DEVICE HAVING A REPLACEABLE PAPER CONVEYING ROLLER

(75) Inventors: Thomas Sheng, Hsinchu (TW); Szu-Hui Lien, Hsinchu (TW)

(73) Assignee: Avision, Inc., Hsin-Chu (TW)

( * ) Notice: Subject to any disclaimer, the term of this patent is extended or adjusted under 35 U.S.C. 154(b) by 137 days.

(21) Appl. No.: 09/766,998

(22) Filed: Jan. 23, 2001

(65) Prior Publication Data

US 2002/0033574 A1 Mar. 21, 2002

(30) Foreign Application Priority Data

Sep. 15, 2000 (TW) ..... 89216081 U

(51) Int. Cl.[7] ..... B65H 3/00
(52) U.S. Cl. ..... 271/18; 384/435
(58) Field of Search ..... 271/18, 109, 3.2, 271/4.07, 4.1, 10.09, 10.13, 127; 198/781.04, 781.08; 355/133; 334/418, 428, 435, 436, 437, 440; 400/629

(56) References Cited

U.S. PATENT DOCUMENTS 4,473,321 A * 9/1984 Culver et al. ..... 114/44
5,261,658 A * 11/1993 Nagai ..... 271/297
5,878,318 A * 3/1999 Sako et al. ..... 399/365
6,024,497 A * 2/2000 Leibman ..... 384/215

FOREIGN PATENT DOCUMENTS

JP 64-87436 * 3/1993 ..... B65H/3/06

* cited by examiner

*Primary Examiner*—Donald P. Walsh
*Assistant Examiner*—Kenneth W Bower
(74) *Attorney, Agent, or Firm*—H. C. Lin

(57) ABSTRACT

A paper feeding device includes a back plate, a first bracket, a second bracket, a shaft, and a friction roller. The first bracket is arranged on the back plate and formed of a first socket. The second bracket is arranged on the back plate and formed of a second socket. The shaft has a first end and a second end opposite to the first end. The first end of the shaft is rotatably mounted in the first socket. The second end of the shaft is rotatably mounted in the second socket. At least one of the first and second sockets is an open-ended socket for facilitating both the insertion and removal of the shaft. The friction roller wraps around the shaft for conveying a piece of paper.

5 Claims, 12 Drawing Sheets

PAPER FEEDING DEVICE HAVING A REPLACEABLE PAPER CONVEYING ROLLER

BACKGROUND OF THE INVENTION

1. Field of the Invention

This invention relates to a paper feeding device having a replaceable paper conveying roller, in particularly, to a replaceable paper conveying roller for paper feeding devices such as a scanner, a printer, a fax machine, or a copier.

2. Brief Description of Related Art

Prior art has used a roller to convey papers in a paper feeding device, as shown in FIG. 1. A back shell 16 wraps around two brackets 11 and 12, which reinforce the shell. The brackets 11 and 12 have two sockets 112 and 122 respectively for mounting a shaft 15. A roller 16, made of friction material, is mounted over the shaft 15. The left end 18 of the shaft 15 feeds through the socket 112, and the right end 19 of the shaft 15 feeds through the socket 122. The shaft 15 is indirectly driven by a gear 17 located at the right end of the shaft 15. When the gear 17 is driven by a motor (not shown), the roller 16 rotates and the friction coveys the paper P forward.

Due to high-speed operation of modern paper feeding devices, the roller 16 experiences wear and tear. The lifetime of the paper feeding device is thus adversely affected.

SUMMARY OF THE INVENTION

An object of this invention is to increase the useful lifetime of a paper feeding device. Another object is to reduce the servicing cost of a paper feeding device.

These objects are achieved by using a replaceable paper conveying roller for a paper feeding device. A paper feeding device of the invention includes a back plate, a first bracket, a second bracket, a shaft, and a friction roller. The first bracket is arranged on the back plate and formed of a first socket. The second bracket is arranged on the back plate and formed of a second socket. The shaft has a first end and a second end opposite to the first end. The first end of the shaft is rotatably mounted in the first socket. The second end of the shaft is rotatably mounted in the second socket. At least one of the first and second sockets is an open-ended socket for facilitating both the insertion and removal of the shaft. The friction roller wraps around the shaft for conveying a piece of paper.

DETAILED DESCRIPTION OF THE INVENTION

Figure 2:
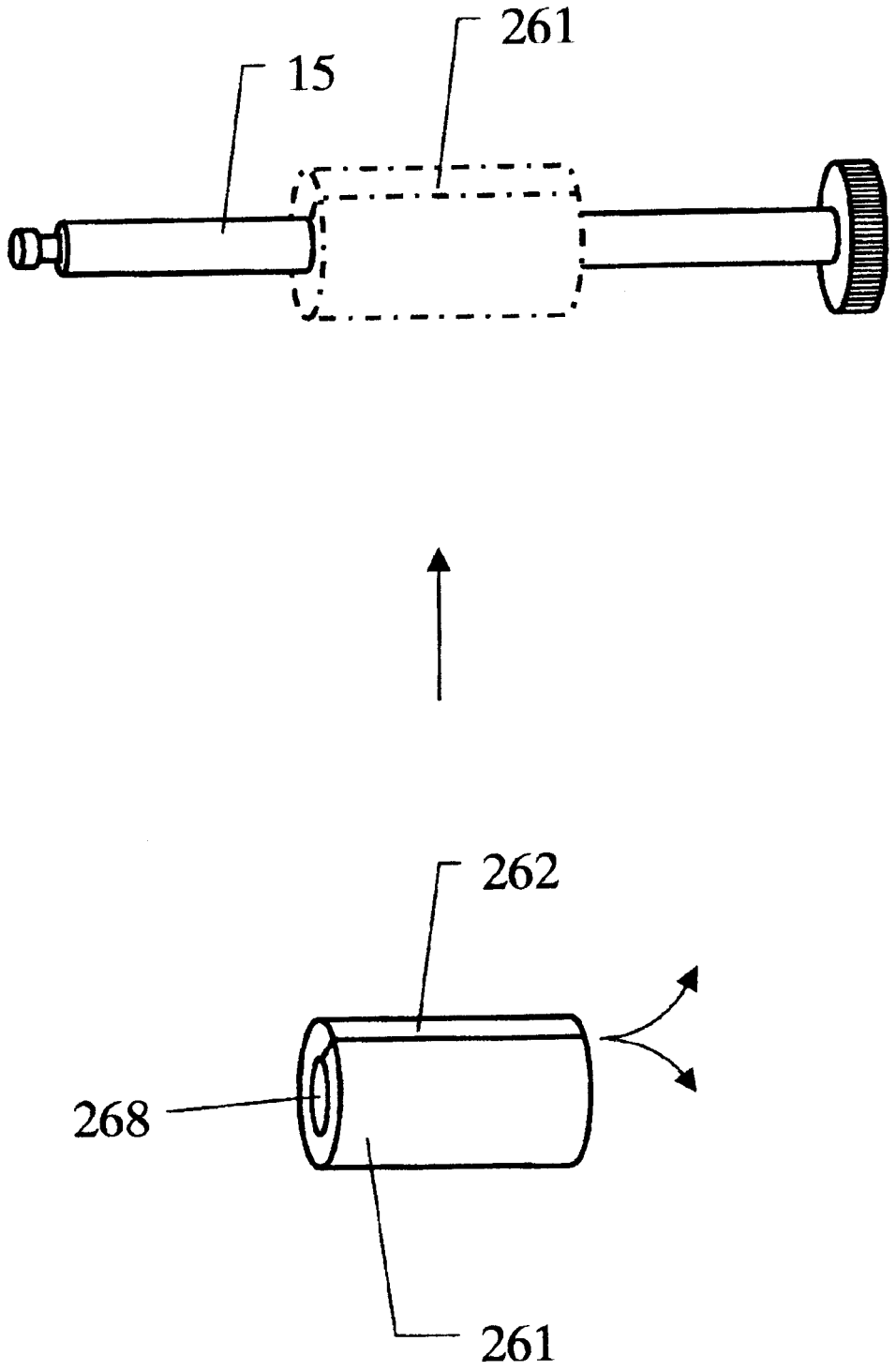
FIG. 2 shows a first embodiment of the conveying roller of the present invention.

FIG. 2 shows a replaceable paper conveying roller (friction roller) 261 according to the present invention. The roller 261 has a cut 262 from the rim of the roller 261 to the edge of a hole 268, which wraps around the shaft 15. The cut 262 allows the friction roller 261 to split along the cut 262 for mounting over or removal from the shaft 15.

Figure 3:
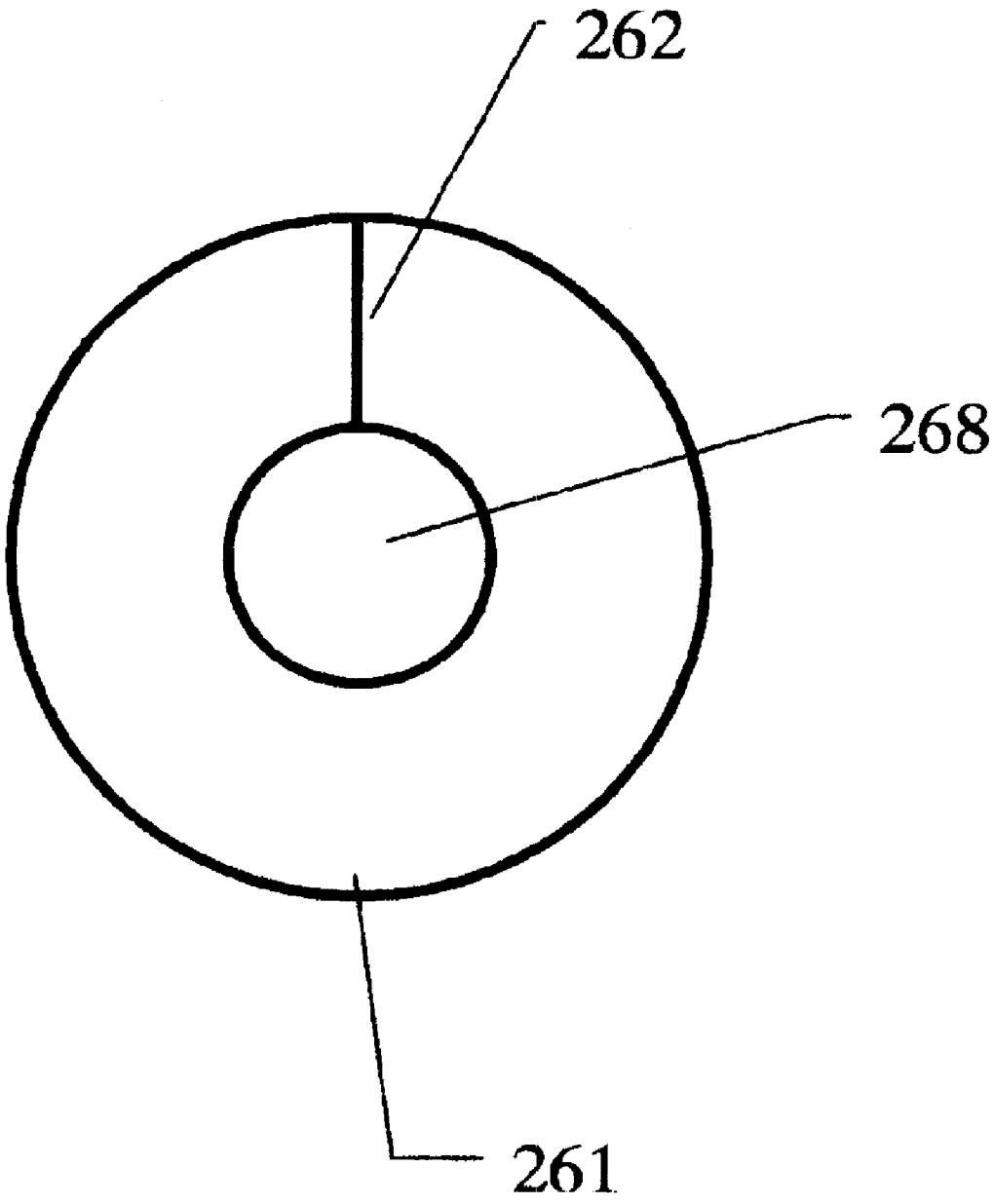
FIG. 3 shows the side view of the FIG. 2.

FIG. 3 shows the side view of the removable friction roller 261 with a cut 262.

Figure 4:
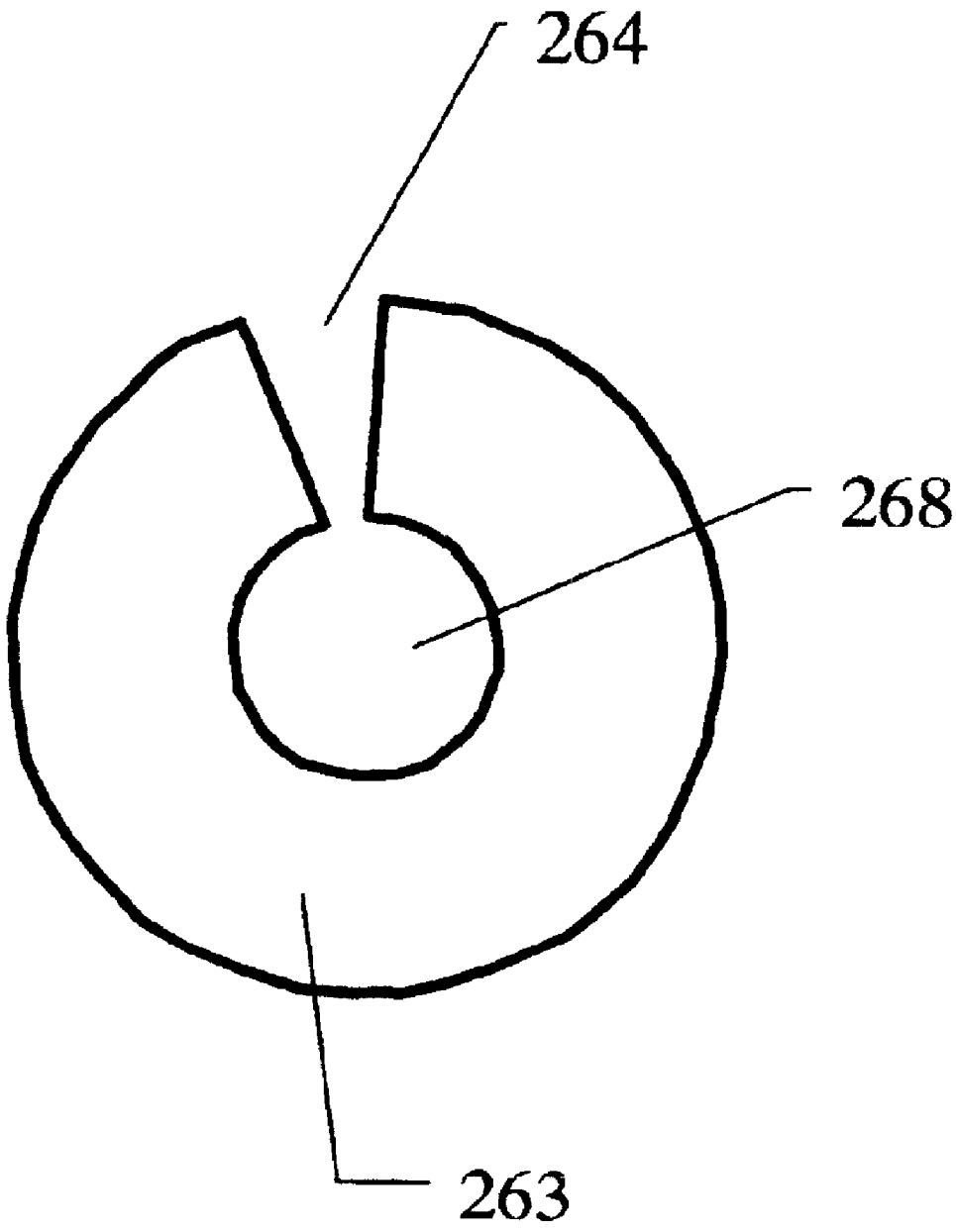
FIG. 4 shows a second embodiment of the conveying roller of the present invention.

FIG. 4 shows a second embodiment of removable friction roller 263, which has a V-shaped cut 264 and a hole 268. While the cut 264 shown as V-shaped, the cut 264 can of other shapes, such a rectangular cut, an arc-shaped cut, an S-shaped cut, or any other regular or irregular cut.

Figure 5:
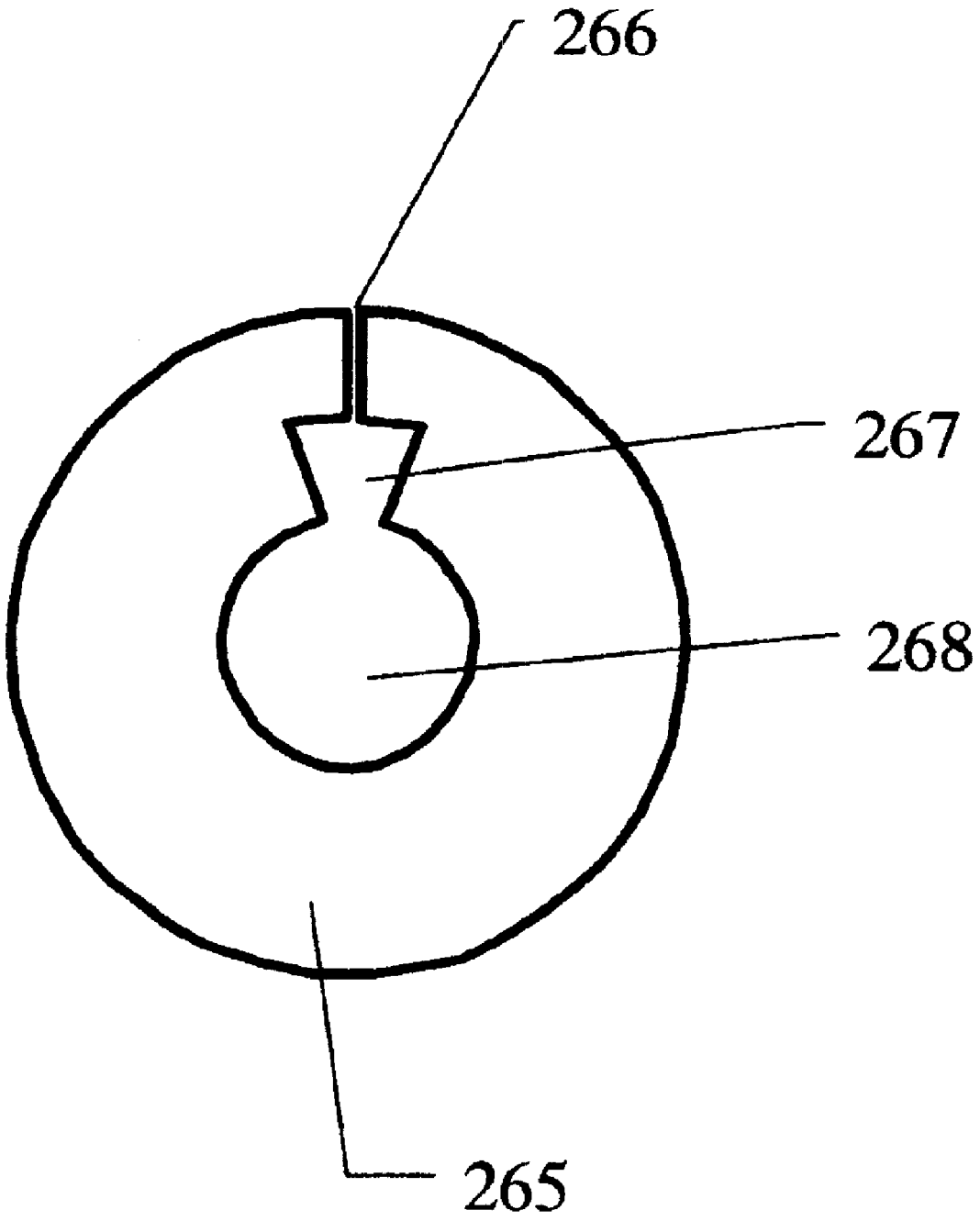
FIG. 5 shows a third embodiment of the conveying roller of the present invention.

FIG. 5 shows a third embodiment of the removable friction roller 265. The roller 265 has a cut 266 from the outer surface of the roller 265 halfway toward the center of the roller 265. The cut 266 is then enlarged into a dovetailed cut toward the center. The narrow cut 266 near the surface of the outer roller 265 is to facilitate complete rubbing the friction roller 265 over the paper. The enlarged cut 267 toward the center is to facilitate removal of the roller 265 from the shaft for replacement.

Figure 1:
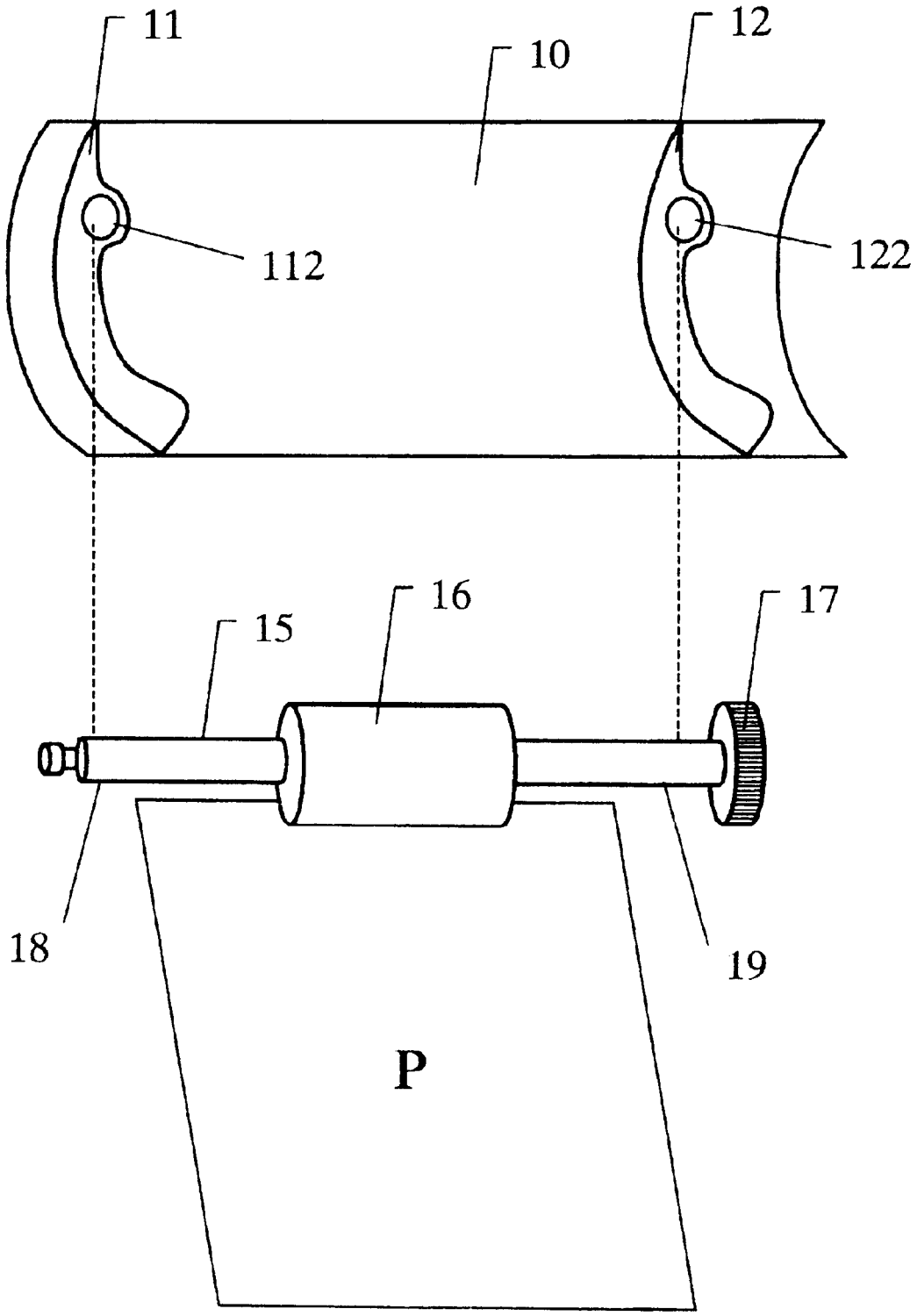
Fig. 1 (Prior Art)
FIG. 1 shows a prior art conveying roller for a paper feeding device.
Figure 6:
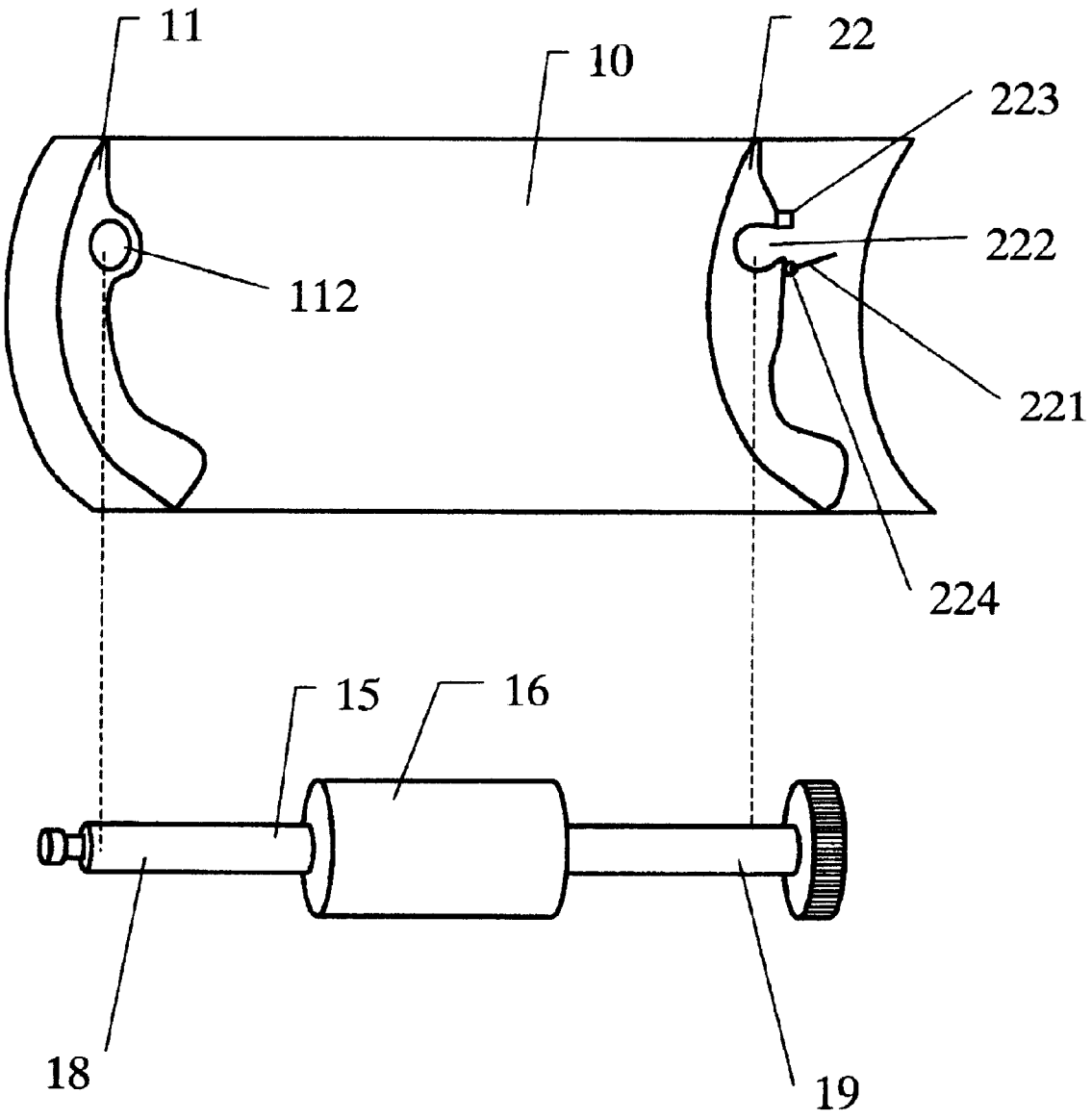
FIG. 6 shows an open-ended socket on one of the supporting brackets.

FIG. 6 shows an open-ended socket on the brackets 11 and 22 mounted on the back shell (back plate) 10. The socket 112 is located in the bracket 11 as in FIG. 1. The socket 222 on the bracket 22 is open-ended for facilitating the insertion and removal of the shaft 15 of the friction roller. The left end 18 of the shaft 15 for mounting the roller is inserted in the socket 112. The right end 19 of the shaft 15 is inserted into the mouth of the open-ended socket 222. After the shaft is inserted, the mouth is closed by a shutter 221 pivoted at a point 224 and hooked at a point 223.

Figure 7:
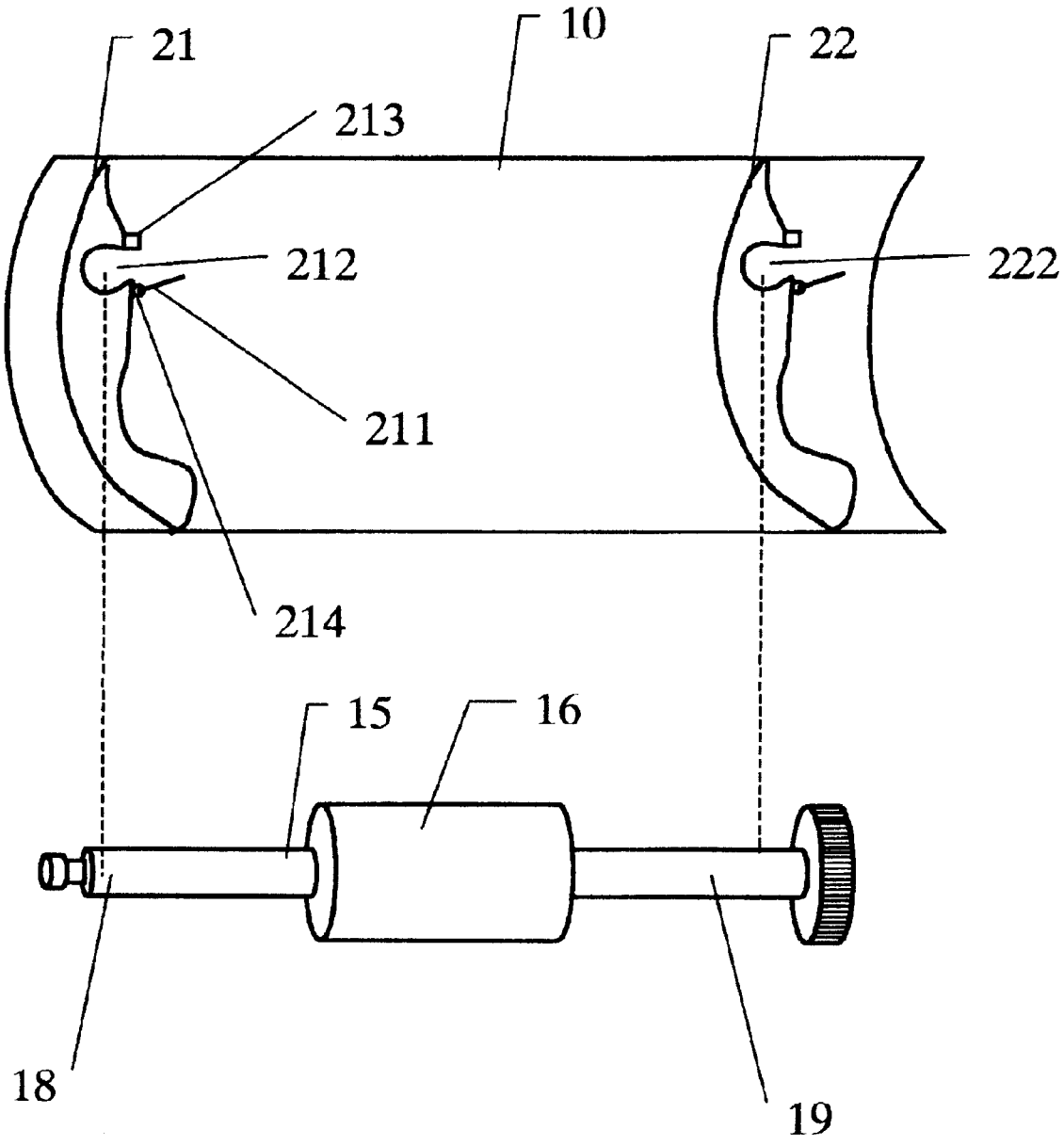
FIG. 7 shows two open-ended sockets on two respective supporting brackets.

FIG.7 shows another sockets of the brackets 21 and 22 mounted on the back shell 10. Both sockets 212 and 222 are open-ended as the socket 222 in FIG. 6 to facilitate insertion and removal the shaft 15. As in socket 222, the socket 212 at the left end has an open mouth which can be closed by a shutter 211 in the form of a bar, which is pivoted at a point 214 and hooked by a catch at a point 213.

Figure 8:
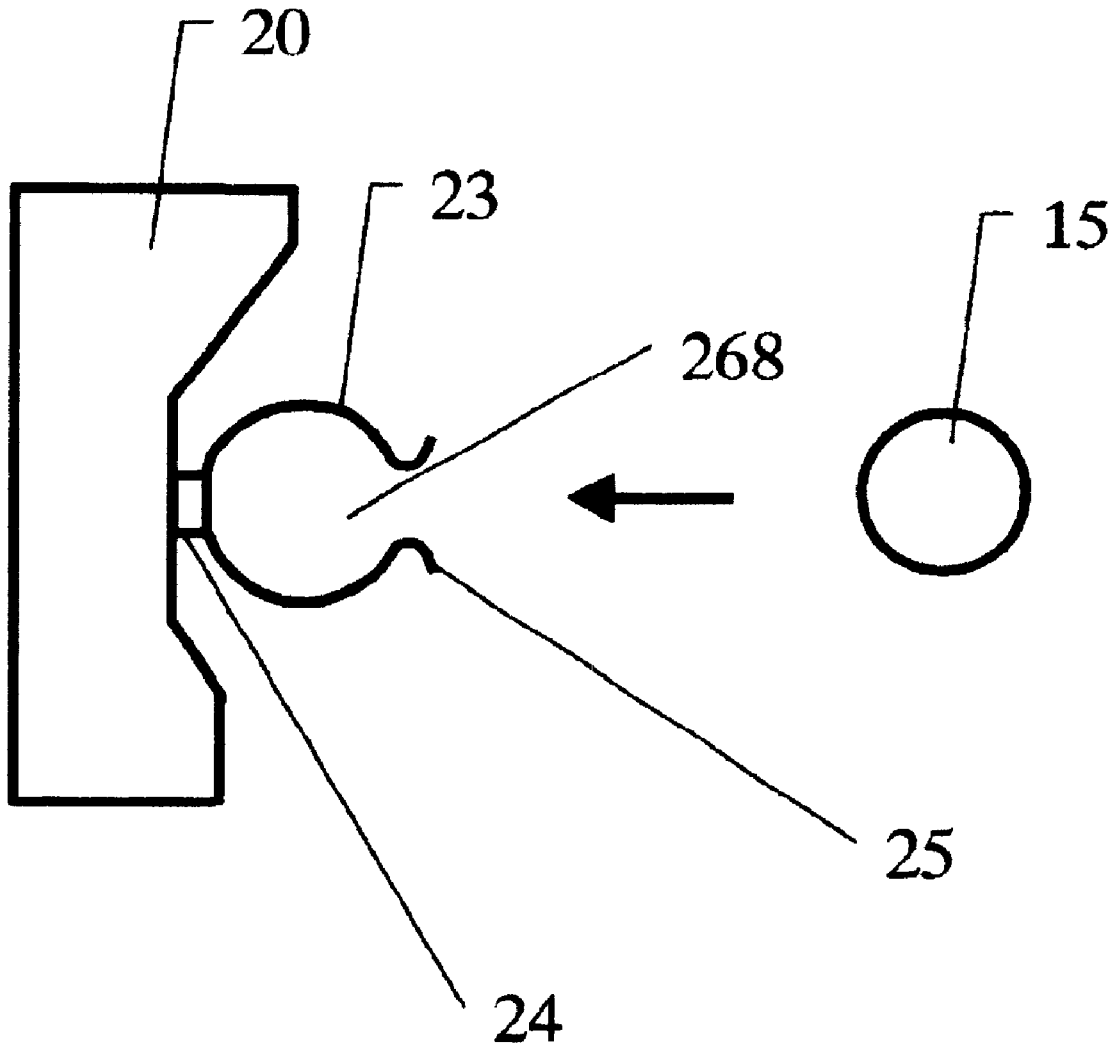
FIG. 8 shows an open-ended socket with two C-shaped springs.

FIG. 8 shows a first version of the socket 268 which has two C-shaped springs 23 and 25 mounted to a back plate (shell) 20 through a fixed neck. 24. The shaft 15 of the roller 16 can be inserted into the socket 268 to hold the roller 16 in place and can be easily removed from the socket 268 for replacement.

Figure 9:
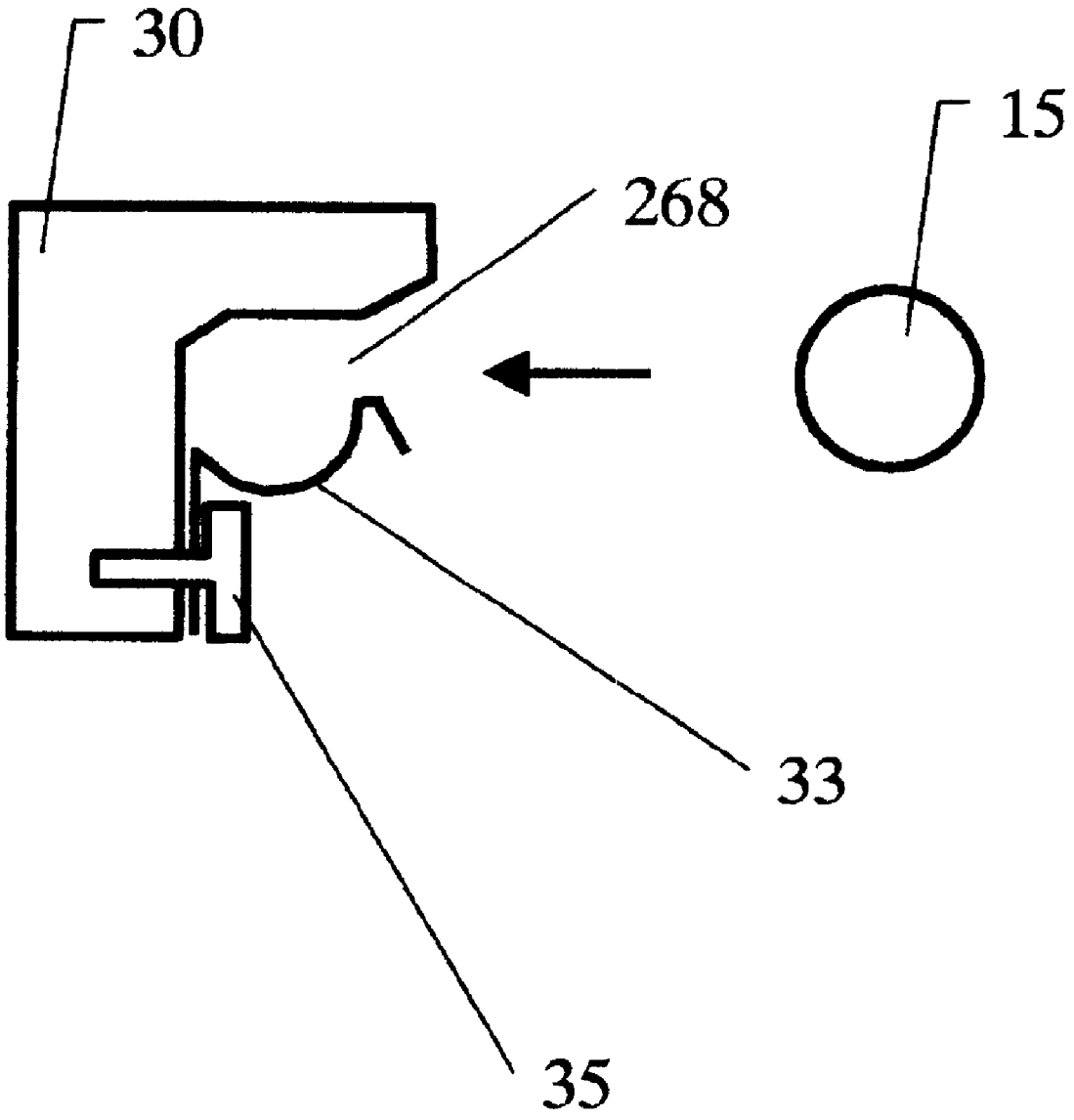
FIG. 9 shows an open-ended socket with one C-shaped spring pressing against a rectangular bracket.

FIG. 9 shows a second version of the socket 268, which has one C-shaped spring 33 mounted to a rectangular back plate 30 through a screw 35. The shaft 15 of the roller 16 can be inserted into the socket 268 to hold the roller 16 in place and can be easily removed from the socket 268 for replacement. As shown, the C-shaped spring presses the shaft 15 against the plate 30 as a wall.

Figure 10:
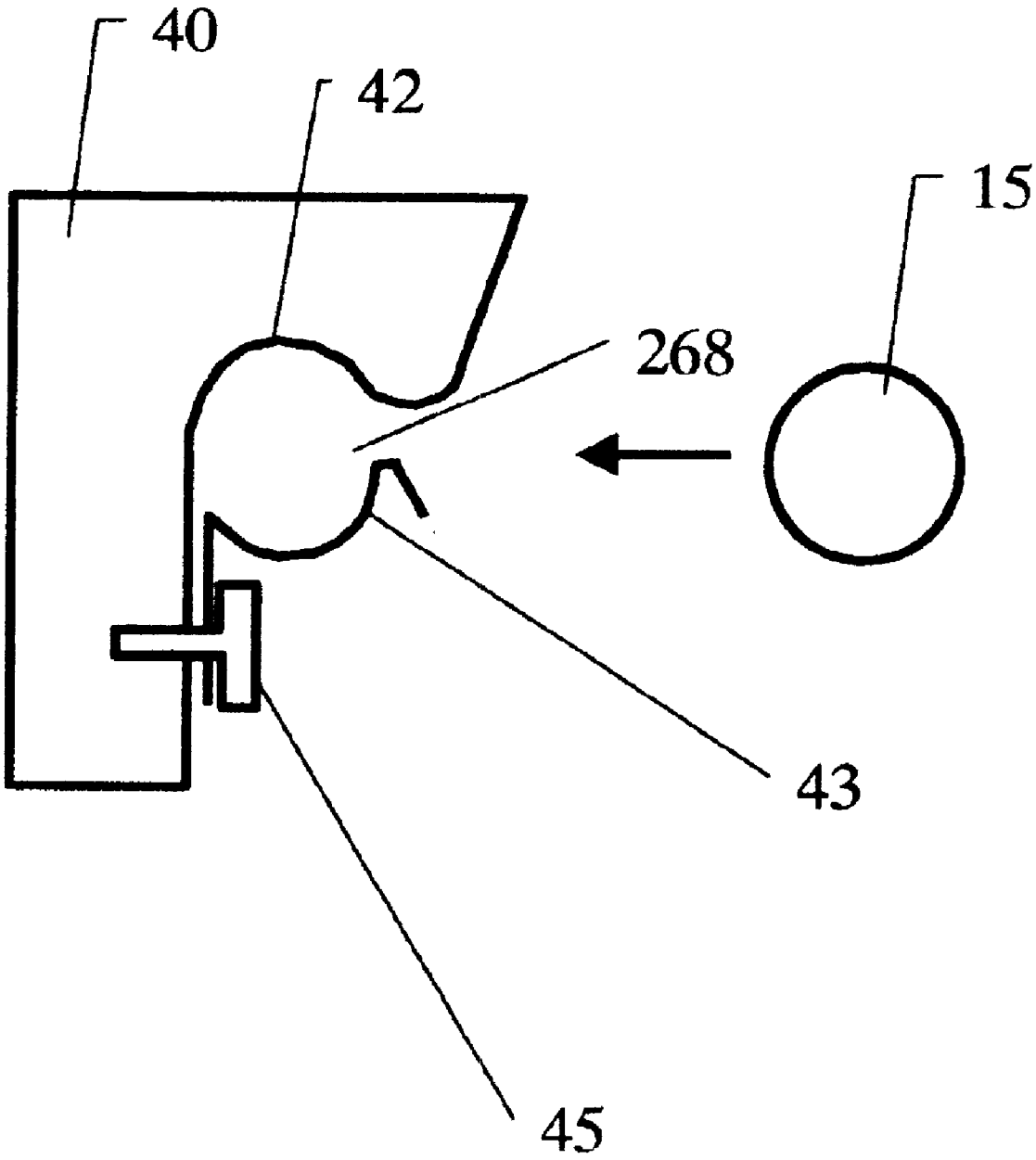
FIG. 10 shows an open-ended socket with a C-shaped spring pressing against a curved bracket.

FIG. 10 shows a third version of the socket 268, which has one C-shaped spring mounted against a back plate 40 with an arc-shaped contour 42 through a screw 45. The shaft 15 of the roller 16 can be inserted snugly into the socket 268 to hold the roller 16 in place and can be easily removed from the socket 268 for replacement.

Figure 11:
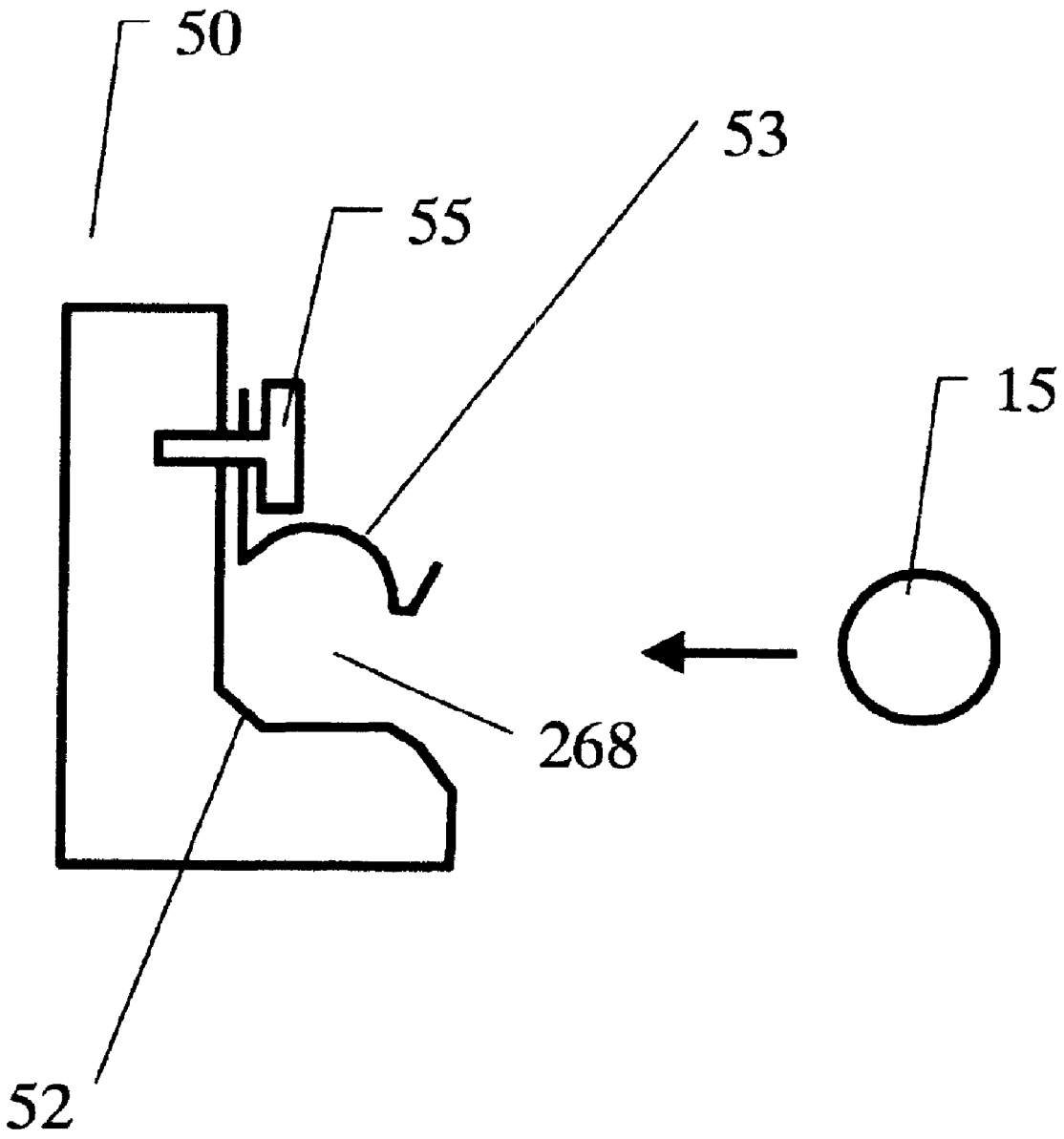
FIG. 11 shows an open-ended socket inverted from that shown in FIG. 9.

FIG. 11 shows a fourth version of the socket 268, which has an inverted structure as that shown in FIG. 9. The socket 268 has one C-shaped spring 53 mounted to a rectangular back plate 50 through a screw 55. The shaft 15 of the roller 16 can be inserted into the socket 268 to hold the roller 16 in place and can be easily removed from the socket 268 for replacement.

Figure 12:
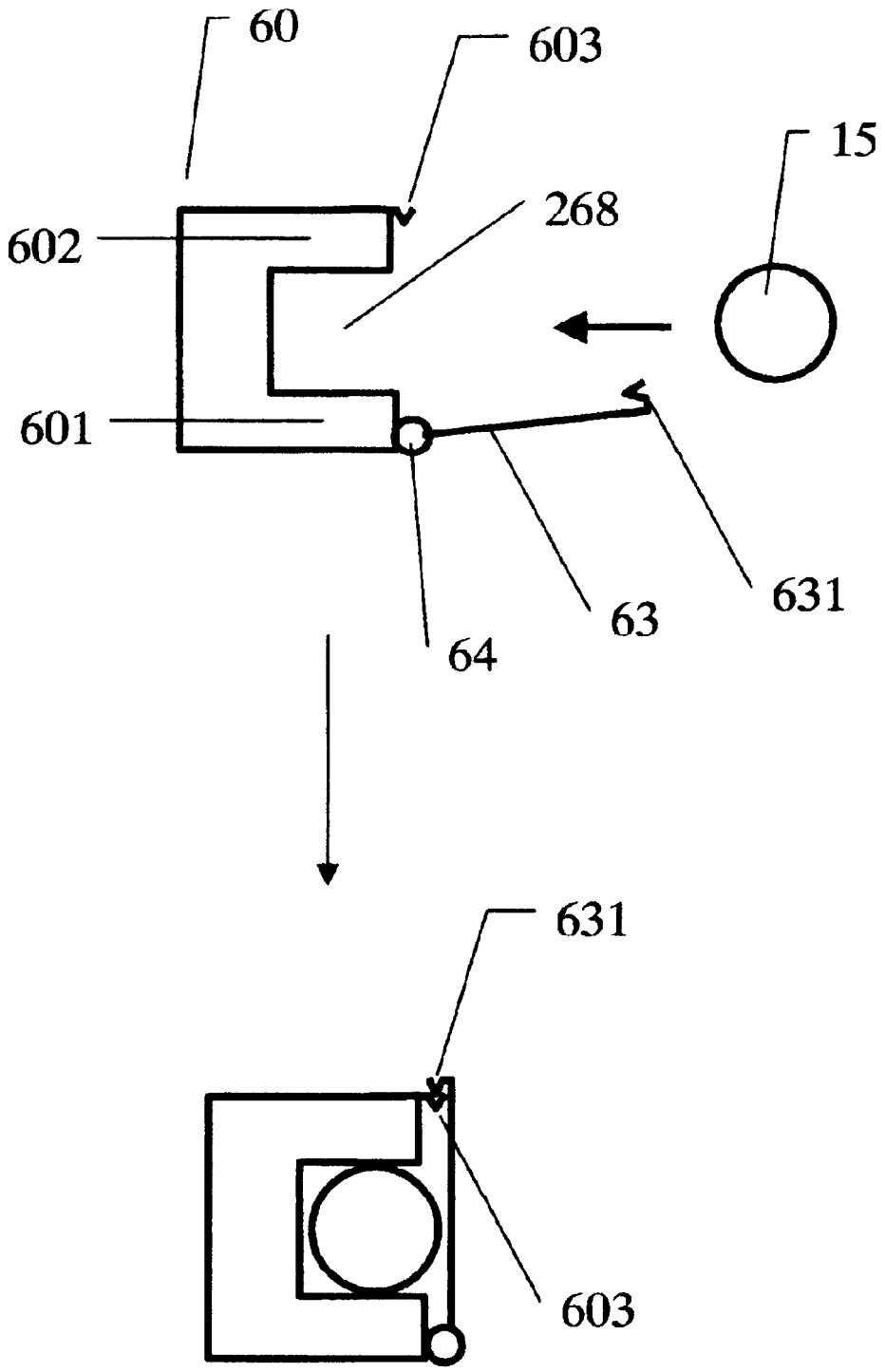
FIG. 12 shows another open-ended socket.

FIG. 12 shows a fifth version of the socket 268, which has a rectangular recess in the back plate 60. The recess forms two jaws 601 and 602. The mouth of each of the jaws 601 and 602 have a door 63, which is hinged at the lower jaw 601 at a point 64. After the shaft 15 of the roller 16 is inserted into the mouth of the socket 268, the door 63 is closed and latched by the engagement members 603 and 631. The shaft 15 can easily be inserted in place and removed from the socket 268 for replacement.

To sum up, referring again to FIG. 6, the paper feeding device of the invention includes a back plate 10, a first bracket 11, a second bracket 22, a shaft 15, and a friction roller 16. The first bracket 11 is arranged on the back plate 10 and formed of a first socket 112. The second bracket 22 is arranged on the back plate 10 and formed of a second socket 222. The shaft 15 has a first end 18 and a second end 19 opposite to the first end 18. The first end 18 of the shaft 15 is rotatably mounted in the first socket 112. The second end 19 of the shaft 15 is rotatably mounted in the second socket 222. At least one of the first and second sockets 112 and 222 is an open-ended socket (222) for facilitating both the insertion and removal of the shaft 15. The friction roller 16 wraps around the shaft 15 for conveying a piece of paper P.

The advantages of the invention will be described in the following by using the scanner as an example.

Because the scanner can scan a lot of documents into electrical files for better management or other usage, the documents to be scanned are getting more and more. To meet the demand of scanning a large quantity of documents, the friction roller is quickly worn out. Thus, the friction roller has to be replaced frequently, just like the situation corresponding to the developer cartridge and the photoconductor unit in the printer. According to this invention, users can replace the roller in the scanner easily just as replacing the developer cartridge in the printer. Therefore, a lot of money can be saved.

While the preferred embodiments of the invention have been described, it will be apparent to those skilled in the art that various modifications may be made in the embodiments without departing from the spirit of the present invention. Such modifications are all within the scope of this invention.

What is claimed is:

1. A paper conveying mechanism, comprising:

a back plate;

a first bracket arranged on the back plate and formed of a first socket;

a second bracket arranged on the back plate and formed of a second socket;

a shaft having a first end and a second end opposite to the first end, the first end thereof being rotatably mounted in the first socket, the second end thereof being rotatably mounted in the second socket, wherein at least one of the first and second sockets being an open-ended socket for facilitating both the insertion and removal of the shaft;

two engagement members for closing/opening the open-ended socket so that the shaft can be firmly mounted and the shaft can be easily removed, wherein the two engagement members comprise a pivoted bar and a catch to latch said pivoted bar.

2. A paper conveying mechanism, comprising:

a back plate;

a first bracket arranged on the back plate and formed of a first socket;

a second bracket arranged on the back plate and formed of a second socket;

a shaft having a first end and second end opposite to the first end, the first end thereof being rotatably mounted in the first socket, the second end thereof being rotatably mounted in the second socket, wherein at least one of the first and second sockets being an open-ended socket for facilitating both the insertion and removal of the shaft; and two engagement members for closing/opening the open-ended socket so that the shaft can be firmly mounted and the shaft can be easily removed, wherein at least one of said engagement members is an elastic jaw to clamp said shaft directly against said socket by engagement of the jaw with the second engagement member.

3. The paper conveying mechanism as described in claim 2, wherein said another of said engagement members is a fixed wall.

4. The paper conveying mechanism as described in claim 3, wherein said fixed wall is cornered.

5. The paper conveying mechanism as described in claim 2, wherein the position of said elastic jaw is adjustable for best fit of said shaft in said second socket.

* * * * *